US009803816B2

(12) United States Patent
Bizzotto et al.

(10) Patent No.: US 9,803,816 B2
(45) Date of Patent: Oct. 31, 2017

(54) STREET LIGHTING DEVICE

(75) Inventors: Alessandro Bizzotto, Castelfranco Veneto (IT); Simone Capeleto, Padua (IT); Matteo Toscan, Maser (IT)

(73) Assignee: OSRAM GmbH, Munich (DE)

( * ) Notice: Subject to any disclaimer, the term of this patent is extended or adjusted under 35 U.S.C. 154(b) by 1243 days.

(21) Appl. No.: 13/576,425

(22) PCT Filed: Jan. 20, 2011

(86) PCT No.: PCT/EP2011/050757

§ 371 (c)(1),
(2), (4) Date: Oct. 10, 2012

(87) PCT Pub. No.: WO2011/092107

PCT Pub. Date: Aug. 4, 2011

(65) Prior Publication Data

US 2013/0026928 A1 Jan. 31, 2013

(30) Foreign Application Priority Data

Feb. 1, 2010 (IT) ..... TO2010A0068

(51) Int. Cl.

| | |
|---|---|
| ***H05B 33/08*** | (2006.01) |
| ***F21S 8/08*** | (2006.01) |
| ***F21V 23/04*** | (2006.01) |
| ***H05B 37/02*** | (2006.01) |

(Continued)

(52) U.S. Cl.

CPC ..... *F21S 8/086* (2013.01); *F21V 23/0442* (2013.01); *H05B 37/0227* (2013.01); *F21W 2131/103* (2013.01); *F21Y 2113/00* (2013.01)

(58) Field of Classification Search

USPC ... 315/88, 90, 152, 153, 154, 158, 159, 291, 315/297, 306, 307, 308, 312

See application file for complete search history.

(56) References Cited

U.S. PATENT DOCUMENTS

| | | | |
|---|---|---|---|
| 2,793,285 | A | 5/1957 | Brainerd |
| 5,422,792 | A | 6/1995 | Neumann |
| 5,894,272 | A | 4/1999 | Brassier et al. |

(Continued)

FOREIGN PATENT DOCUMENTS

| | | | |
|---|---|---|---|
| CH | 164033 | A | 9/1933 |
| CN | 2823798 | Y | 10/2006 |

(Continued)

OTHER PUBLICATIONS

English abstract of KR 100932917 B1.Dec. 21, 2009.

(Continued)

*Primary Examiner* — Douglas W Owens
*Assistant Examiner* — Jianzi Chen
(74) *Attorney, Agent, or Firm* — Viering, Jentschura & Partner mbB

(57) ABSTRACT

In various embodiments, a street lighting device with a first light source for illuminating the street plane from above is provided. The device may include a second light source located at a closer position to the street plane than said first light source; a sensor sensitive to the occurrence of conditions of reduced ambient visibility; and a controller connected to said sensor and capable of activating said second light source in the presence of said conditions of reduced ambient visibility.

20 Claims, 3 Drawing Sheets

(51) Int. Cl.
*F21W 131/103* (2006.01)
*F21Y 113/00* (2016.01)

(56) References Cited

U.S. PATENT DOCUMENTS

| | | | | |
|---|---|---|---|---|
| 7,566,150 | B2 * | 7/2009 | Adrien | E01F 9/65 248/125.2 |
| 2009/0040750 | A1 * | 2/2009 | Myer | F21S 8/083 362/183 |

FOREIGN PATENT DOCUMENTS

| | | | | |
|---|---|---|---|---|
| CN | 101435540 | A * | 5/2009 | 362/183 |
| CN | 201259139 | Y | 6/2009 | |
| CN | 101476711 | A | 7/2009 | |
| DE | 102007061160 | A1 | 6/2009 | |
| EP | 0516527 | A1 | 12/1992 | |
| EP | 0574359 | A1 | 12/1993 | |
| FR | 749910 | A | 8/1933 | |
| JP | 2005002773 | A | 1/2005 | |
| KR | 100932917 | B1 | 12/2009 | |

OTHER PUBLICATIONS

English machine-generated translation of the summary of FR749910 A. Aug. 1, 1933.
English abstract of DE 102007061160 A1. Jun. 25, 2009.
English abstract of JP 2005002773 A. Jan. 6, 2005.
English machine-generated translation of the description of CH 164033 A. Sep. 15, 1933.
Office Action received for Chinese Patent Application No. 201180007502.1, dated Dec. 5, 2014, 18 pages of Office Action and 10 pages of English translation.
Chinese Office Action for Application No. 201180007502.1; dated Dec. 25, 2013; 14 pages (with translation).
Office Action issued in the corresponding Chinese application No. 201180007502.1, dated Jun. 19, 2014 (with translation).

* cited by examiner

STREET LIGHTING DEVICE

RELATED APPLICATIONS

The present application is a national stage entry according to 35 U.S.C. §371 of PCT application No.: PCT/EP2011/050757 filed on Jan. 20, 2011, which claims priority from. Italian application No.: TO2010A000068 filed on Feb. 1, 2010.

TECHNICAL FIELD

The present description relates to street lighting devices.

The description is particularly concerned with the possible application to street lighting in conditions of poor ambient visibility, caused for example by the presence of fog.

BACKGROUND

A street lighting device of the most commonly used type (such as a lamp post) comprises a structure 10 which supports at a certain height a light source 12 intended to project light radiation downward toward the street plane S.

As shown schematically in FIG. 1 of the appended drawings, this form of lighting is such that, in conditions of reduced visibility, for example in the presence of fog or other atmospheric precipitation such as rain, snow or smoke, the lighting of the street plane S is far from optimal. It may even be the case that visibility at the level of the street plane S is worsened by the effect of the lighting. Even on lighted stretches of road, drivers may therefore always prefer to use any fog lamps which are available on their vehicles.

The inventors have observed that any worsening of visibility as a result of the switching on of street lighting is due to the fact that, in these conditions, the degree of visibility of the street plane S by an observer O (such as a driver) can be modeled as the superimposition of two components, namely:

- a "signal" component, corresponding to the light emitted from the observed scene, which diffuses (back) toward the observer O the light radiation originating from the source 12 and from any vehicle headlights that may be present;
- a "noise" component, corresponding to the light from the source 12 diffused by diffusion sources DS such as fog droplets, raindrops, snowflakes or particles of smoke.

SUMMARY

Various embodiments may overcome the problems arising from the unsatisfactory operation of street lighting devices in the conditions described above.

The claims form an integral part of the technical teachings provided herein in relation to the invention.

BRIEF DESCRIPTION OF THE APPENDED DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which:

FIG. 1 has been described above,

DETAILED DESCRIPTION

Figure 1:
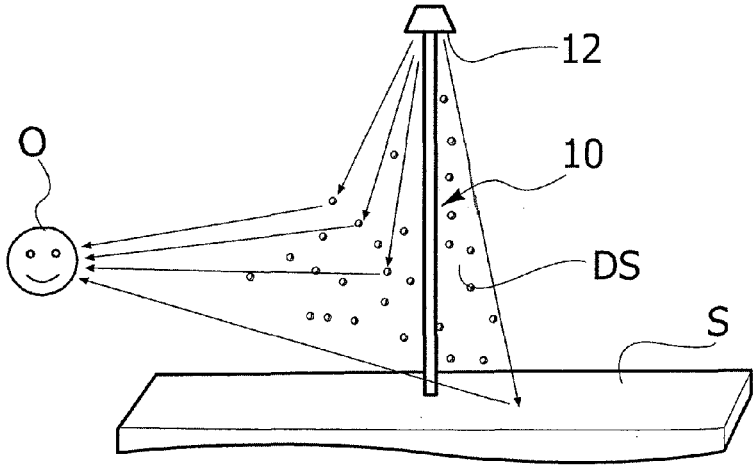

The following description illustrates various specific details intended to provide a deeper understanding of the embodiments. The embodiments may be produced without one or more of the specific details, or may use other methods, components, materials, etc. In other cases, known structures, materials or operations are not shown or described in detail, in order to avoid obscuring various aspects of the embodiments.

The reference to "an embodiment" in this description is intended to indicate that a particular configuration, structure or characteristic described in relation to the embodiment is included in at least one embodiment. Therefore, phrases such as "in an embodiment", which may be present in various parts of this description, do not necessarily refer to the same embodiment. Furthermore, specific formations, structures or characteristics may be combined in a suitable way in one or more embodiments.

The references used herein are purely for convenience and therefore do not define the scope of protection or the extent of the embodiments.

In the drawings, the reference 10 indicates the whole of a street lighting device which, in the embodiment considered here, takes the form of a pole or lamp post provided at its upper end with a light source 12 which can, for example, be an LED lighting module (lamp or luminaire).

In various embodiments, the lamp 12, which is a first light source for lighting the street plane S from above, operates by projecting a light beam 12A downward toward the street plane.

For this purpose, the lamp 12 can be supported by a pole or column 14. It will be appreciated that the use of this specific suspension or support structure is not essential: various embodiments may, for example, make use of suspension on an overhead line, mounting on a gateway, support by means of a bracket affixed to the facade of a building, or other arrangements.

The reference 16 indicates another light source, which can also be an LED lighting module for example, and which is intended to serve as a further source of light radiation located in the lower part of the device 10 so as to be at a position closer to the street plane S than the first light source 12. In other words, the second light source is at a lower position than the first source 12.

Figure 2:
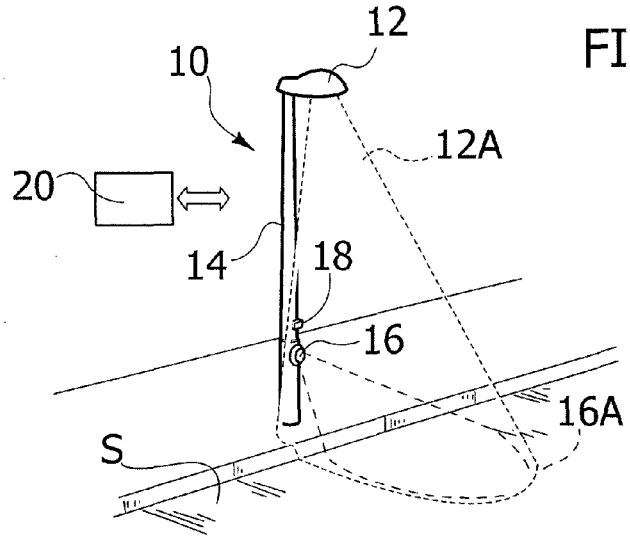
PRIOR ART FIG. 2
FIG. 2 shows one embodiment.

It will be evident from FIG. 2 that, by comparison with the lighting beam 12A of the first source 12 (which is projected onto the street plane S from a position which can be considered azimuthal or approximately azimuthal), the beam of radiation 16A produced by the second source 16 reaches the street plane S from a lesser height and travels in a much more inclined, quasi-horizontal direction.

The inclination of the beam 16A depends on the height of mounting of the second light source 16. In some embodiments, this height is set at rather low levels, of the order of several tens of centimeters, for example at levels approximately equal to the height at which the fog lamps of motor vehicles are located with respect to the street plane. The values concerned may therefore fall within the range of 15 to 60 cm, for example.

The reference numeral 18 indicates a sensor capable of identifying the occurrence of conditions of reduced ambient visibility. The sensor can therefore be of the type known as a "twilight sensor", used to switch on lighting systems in the area of buildings in conditions of reduced ambient light levels.

While it can also be used to detect the occurrence of conditions of reduced ambient visibility and cause street lighting to be switched on (although this function may be served by a central "twilight" system controlling a plurality of devices), in various embodiments the sensor 18 is mounted at a certain distance from the first source 12 (in the proximity of the second source 16, for example), at a position such that it can be impinged upon by the radiation emitted by the first light source 12. Thus the sensor 18 can detect—when the source 12 is switched on—the fact that the light radiation emitted by the source 12 is subject to diffusion, for example by fog, smoke or other diffusion sources DS.

Figure 3:
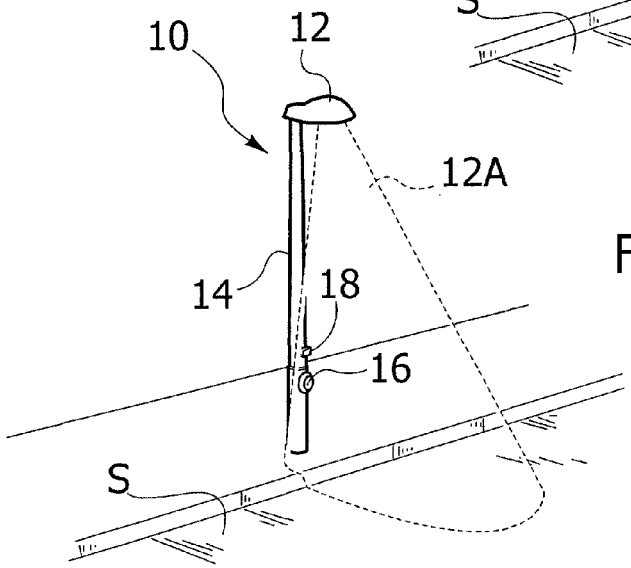
FIGS. 3 to 5 show the operating principles of one embodiment.
Figure 4:
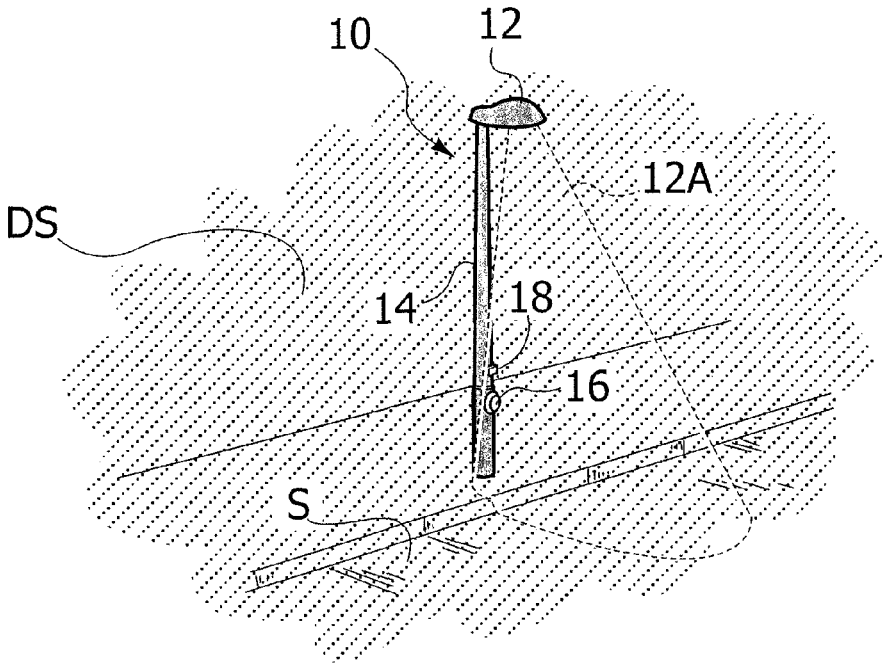

By adjusting the threshold of sensitivity of the sensor 18 (according to known principles), it is therefore possible to distinguish between:

- the situation shown schematically in FIG. 3, in which the lamp 12 is assumed to be switched on, for example at night, in normal ambient and atmospheric conditions (in the absence of fog or other phenomena having a negative effect on visibility); and
- the situation shown schematically in FIG. 4, in which it is again assumed that the lamp 12 is switched on, but this time in the presence of fog or other DS phenomena having a negative effect on visibility: this is because these phenomena invariably cause a reduction in the intensity of the light radiation which impinges upon the sensor 18, regardless of the intensity of radiation emitted by the source 12.

Figure 5:
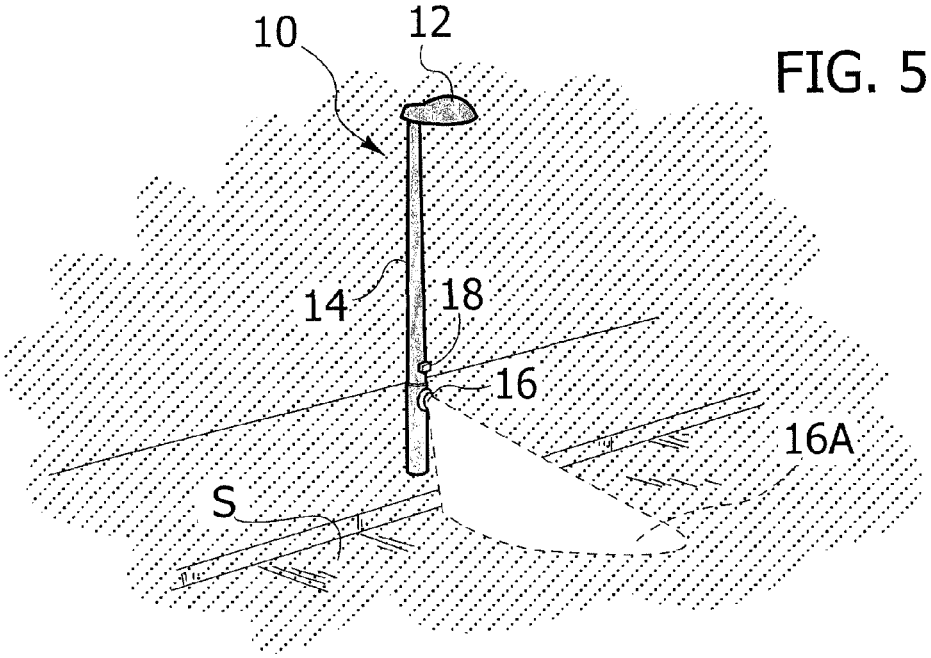

In the latter case (that is to say, when the sensor 18 detects the occurrence of conditions of reduced visibility), a control device 20 which receives the output signal of the sensor 18 acts on the light sources 12 and 16 by switching on the light source 16, as shown schematically in FIG. 5.

As mentioned previously, the source 16 is closer to the street plane S than the source 12, and it can therefore light the street plane S more effectively, being assisted in this by the orientation of the beam 16A which it produces. These factors are also relevant for the possibility of making the edges of the street easier to identify, for example by drivers traveling along a street to which the plane S corresponds.

In various embodiments, the light radiation 16A emitted by the source 16 can have characteristics which are at least marginally different from those of the radiation 12A produced by the main light source 12.

In various embodiments, the auxiliary source 16 can generate a "warm" white radiation or a radiation having a colored component, such as a red component, which can be perceived as such and is therefore easier to distinguish as originating from a light source intended to improve visibility and safety in adverse atmospheric conditions.

In various embodiments, the module 20 can switch on the source while keeping unchanged the intensity of the radiation produced by the first light source 12.

Since, as has been mentioned, the diffusion of this radiation, by fog for example, is one of the causes of the possible worsening of visibility, in various embodiments the module 20 can act to reduce the intensity of the radiation produced by the source 12 when the source 16 is switched on.

In various embodiments, the light sources 12 and 16 can be two separate light generators (such as two LED-type "light engines") which can be switched on selectively (with emission levels which can be controlled, depending on the embodiment, in on/off mode or with an emission intensity control or "dimming" function).

In various embodiments, the light sources 12 and 16 can be two different diffusion points for the light radiation produced by a single light generator, located for example in the device 10. In various embodiments, this single light generator can be connected to the two sources 12 and 16 by optical waveguides, with the provision of an optical switch that can be actuated to vary selectively (in a complementary way, for example) the intensity of the radiation sent toward the first source 12, located at the "high" position, and the intensity of the radiation sent toward the second source 16, located at the "low" position. Optical switches of this type are known in the technical field of fiber optic communications. However, it is not essential to use fiber optics, since the propagation of optical radiation from a single generator toward two (or more) different diffusion sources 12 and 16 with selective variation of the corresponding levels of relative intensity of the radiation sent to the two diffusion points can also be achieved by the propagation of optical radiation in free air. The switching function can be provided according to various principles, for example by using an electro-optical device (such as a liquid crystal device) or by means of a mirror and/or prism structure which is motorized and is therefore selectively orientable.

Different choices may also be made regarding the possible location of a single light radiation generator capable of supplying a plurality of light sources 12 and 16.

In various embodiments, this generator can be located in the upper part of the device 10, and can even form part of the source 12, with provision for "tapping off" from the source 12 a selectively controllable quantity of radiation to be sent toward the source 16.

In various embodiments, this generator can be located in the lower part of the device 10, and can even form part of the source 16, with provision for "tapping off" from the source 16 a selectively controllable quantity of radiation to be sent toward the source 12.

Figure 6:
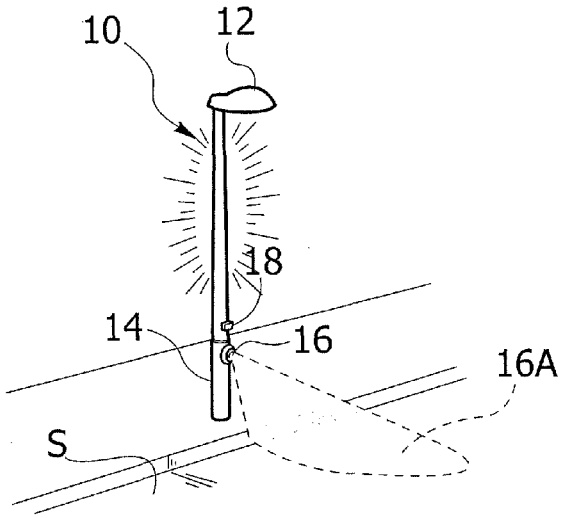
FIGS. 6 and 7 show some developments of embodiments.
Figure 7:
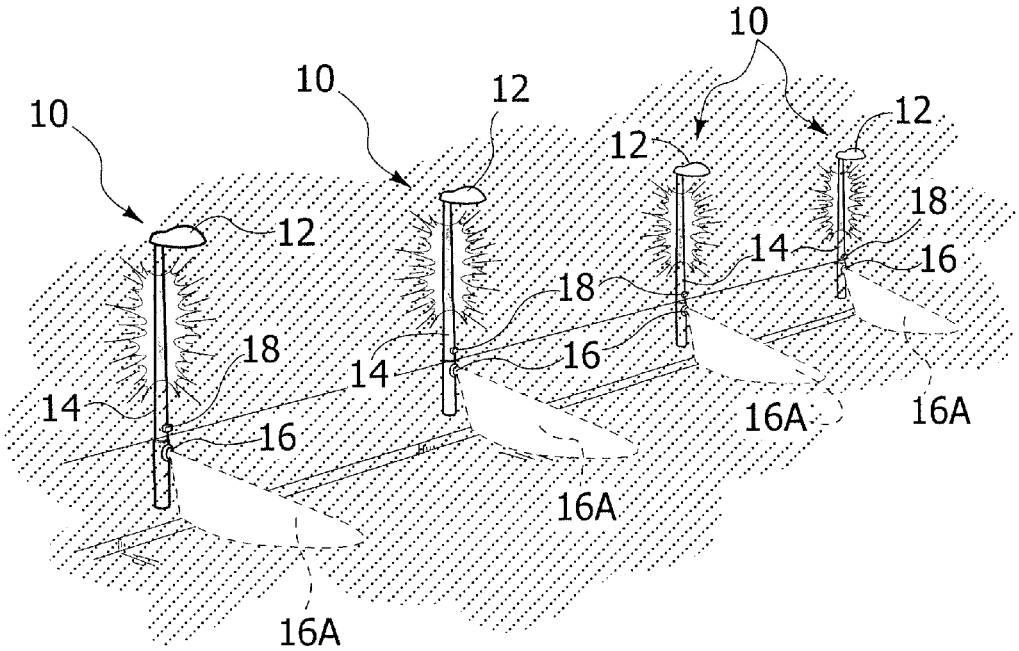

FIGS. 6 and 7 refer to various embodiments in which part of the device 10 between the upper light source 12 and the lower light source 16 can be made from an optically diffusive (or illuminable) material which, in conditions of reduced visibility, can be activated, for example by diverting toward it some of the radiation produced by the light generator or generators which supply the sources 12 and 16, thereby making the structure of the device 10 luminous and thus more visible, as shown schematically in FIGS. 6 and 7.

Consequently, various embodiments can increase visibility, in the presence of fog or smoke for example, by preventing or at least minimizing the phenomenon of diffusion (scattering) of the light radiation produced by the light source 12 located at the upper end of the device 10. In the embodiments shown in FIGS. 6 and 7, the illumination of the support structure of the device 10 makes it possible to provide information on the direction of a street on which a plurality of devices 10 are located to a driver who has to drive a vehicle along the street, without directly interfering with his direction of view.

Naturally, the principle of the invention remaining the same, the details of construction and the forms of embodiment may be varied significantly with respect to those illustrated in the form of non-limiting examples only, without thereby departing from the scope of protection of the invention as defined in the attached claims.

The invention claimed is:

1. A street lighting device with a first light source for illuminating the street plane from above, the device comprising:

a second light source located at a closer position to the street plane than said first light source;

a sensor sensitive to the occurrence of conditions of reduced ambient visibility; and a controller connected to said sensor and capable of activating said second light source in the presence of said conditions of reduced ambient visibility, wherein said sensor is impinged upon by the light radiation emitted by said first light source and is capable of identifying the presence of said conditions of reduced ambient visibility when the intensity of the radiation emitted by said first light source and impinging upon said sensor falls below a given threshold level.

2. The device as claimed in claim 1, wherein said second light source is located at a height in the range from 15 cm to 60 cm above the street plane.

3. The device as claimed in claim 1, wherein said second light source is configured to project a lighting beam in a quasi-horizontal direction of propagation.

4. The device as claimed in claim 1, wherein said second light source is configured to emit a warm white light radiation or a colored light radiation.

5. The device as claimed in claim 1, wherein said first light source and said second light source are separate light generators.

6. The device as claimed in claim 5, wherein said light generators are of the light emitting diode type.

7. The device as claimed in claim 1, further comprising:

a single light generator, whose light radiation is distributed selectively toward said first light source and toward said second light source.

8. The device as claimed in claim 7, wherein said single light generator is one of said first light source and said second light source.

9. The device as claimed in claim 7, wherein said single light generator is of the LED type.

10. The device as claimed in claim 1, further comprising:

a support structure of an illuminable material which can be activated by said controller in said conditions of reduced visibility.

11. A street lighting device with a first light source for illuminating the street plane from above, the device comprising:

a second light source located at a closer position to the street plane than said first light source;

a sensor sensitive to the occurrence of conditions of reduced ambient visibility; and a controller connected to said sensor and capable of activating said second light source in the presence of said conditions of reduced ambient visibility, wherein said controller is configured for activating said second light source and reducing the intensity of the light radiation emitted by said first light source when said conditions of reduced ambient visibility are present.

12. The device as claimed in claim 11, wherein said second light source is located at a height in the range from 15 cm to 60 cm above the street plane.

13. The device as claimed in claim 11, wherein said second light source is configured to project a lighting beam in a quasi-horizontal direction of propagation.

14. The device as claimed in claim 11, wherein said second light source is configured to emit a warm white light radiation or a colored light radiation.

15. The device as claimed in claim 11, wherein said first light source and said second light source are separate light generators.

16. The device as claimed in claim 15, wherein said light generators are of the light emitting diode type.

17. The device as claimed in claim 11, further comprising:

a single light generator, whose light radiation is distributed selectively toward said first light source and toward said second light source.

18. The device as claimed in claim 17, wherein said single light generator is one of said first light source and said second light source.

19. The device as claimed in claim 17, wherein said single light generator is of the LED type.

20. The device as claimed in claim 11, further comprising:

a support structure of an illuminable material which can be activated by said controller in said conditions of reduced visibility.

* * * * *